US005616015A

United States Patent [19]

Liepert

[11] Patent Number: 5,616,015

[45] Date of Patent: Apr. 1, 1997

[54] HIGH DISPLACEMENT RATE, SCROLL-TYPE, FLUID HANDLING APPARATUS

[75] Inventor: Anthony Liepert, Lincoln, Mass.

[73] Assignee: Varian Associates, Inc., Palo Alto, Calif.

[21] Appl. No.: 484,145

[22] Filed: Jun. 7, 1995

[51] Int. Cl.$^6$ ..... F04C 18/04; F04C 23/00; F04C 25/02

[52] U.S. Cl. ..... 418/5; 418/55.2; 418/55.3; 418/60

[58] Field of Search ..... 418/5, 6, 55.2, 418/55.3, 59, 60

[56] References Cited

U.S. PATENT DOCUMENTS

| | | | |
|---|---|---|---|
| 801,182 | 10/1905 | Creux | 418/6 |
| 2,475,247 | 7/1949 | Mikulasek | 418/6 |
| 2,494,100 | 1/1950 | Mikulasek | 418/6 |
| 3,802,809 | 4/1974 | Vulliez | 418/5 |
| 3,989,422 | 11/1976 | Guttinger | 418/55.2 |
| 4,157,234 | 6/1979 | Weaver et al. | 418/6 |
| 4,192,152 | 3/1980 | Armstrong et al. | 62/402 |
| 4,259,043 | 3/1981 | Hidden et al. | 418/55.3 |
| 4,477,238 | 10/1984 | Terauchi | 418/5 |
| 4,650,405 | 3/1987 | Iwanami et al. | 418/5 |
| 4,715,797 | 12/1987 | Guttinger | 418/55.2 |
| 4,861,244 | 8/1989 | Kolb et al. | 418/15 |
| 4,990,072 | 2/1991 | Guttinger | 418/55.3 |
| 5,304,047 | 4/1994 | Shibamoto | 418/5 |

FOREIGN PATENT DOCUMENTS

| | | | |
|---|---|---|---|
| 6101666 | 4/1994 | Japan | 418/55.2 |
| 220296 | 1/1925 | United Kingdom . | |

*Primary Examiner*—John J. Vrablik
*Attorney, Agent, or Firm*—Peter J. Manus; Bella Fishman

[57] ABSTRACT

A positive displacement fluid handling apparatus has a first, high volumetric displacement rate scroll pump of nested interacting pairs of fixed and movable spiral-shaped blades supported in a housing between an inlet and an outlet. Each adjacent blade pair is of sufficient angular extent, preferably only about 360°, to close an inter-blade pocket. In a preferred form for a vacuum pump, a second scroll pump mounted in the housing has its fluid inlet in direct fluid communication with the first scroll outlet. The second scroll has a single pair of co-acting fixed and movable blades with multiple revolutions with a relatively short axial height. The low back leakage of this second pump allows the first pump to omit tip seals on the free spiral edges of the blades. The volumetric displacement rate of the first pump exceeds that of the second pump. An orbiting plate carries the movable blades of both scroll pumps. The drive has a small crank radius which reduces seal velocity and wear, and reduces radial crank force. Ball thrust bearings held between recesses in the periphery and in the plate offset axially directed compressive forces while synchronizing the orbiting movement. A fan mounted on the drive air cools the apparatus. There is no oil or other liquid lubricant or coolant exposed to the working fluid.

21 Claims, 5 Drawing Sheets

HIGH DISPLACEMENT RATE, SCROLL-TYPE, FLUID HANDLING APPARATUS

BACKGROUND OF THE INVENTION

This invention relates in general to fluid handling apparatus, and in particular to a scroll-type, two-stage, positive displacement, vacuum pump useful in general roughing pump applications.

The general operating principles of scroll pumps are described in 1905 U.S. Pat. No. 801,182 to Creux. A movable spiral blade (sometimes termed a "wrap" or "wall") orbits with respect to a fixed spiral blade within a housing. The configuration of the blades and their relative motion traps one or more volumes or "pockets" of a fluid between the blades and moves the fluid through the pump. Creux describes using the energy of steam to drive the blades to produce a rotary power output. Most applications, however, apply a rotary power to pump a fluid through the device. Oil lubricated scroll pumps are widely used as refrigerant compressors. Other applications include expanders (operating in reverse from a compressor), and vacuum pumps. To date, scroll-type pumps have not been widely adopted for use as vacuum pumps.

Scroll pumps must satisfy a number of often competing design objectives. Blades must be configured to interact with each other so that their relative motion defines the pockets that transport, and often compress, the fluid held in the pockets. The blades must therefore move relative to each other, yet also seal. In vacuum pumping, the vacuum level achievable by the pump is often limited by the tendency of high pressure gas at the outlet to flow backwards toward the lower pressure inlet region. The effectiveness and durability of the blade seals, both tip seals along their spiral edges and clearance seals between fixed and movable blades, are important determinants of performance and reliability.

Friction in the drive, blade motion, and seals, as well as the compression of the working fluid, produce wear and heat. It is necessary to cool the apparatus. A wide variety of techniques are known. They include air cooling, flows of refrigerants, and flows or sprays of a lubricant which acts as a heat sink and transfer medium as well as a lubricant. Oil lubrication is the most common technique. Lubrication can also aid in sealing the movable component acting on the working fluid. However, when oil or other lubricants are used in vacuum pumps, as the pressure falls to low levels, the vapor pressure of the lubricant itself contributes lubricant to the gas which, to some degree, offsets the action of the pump. Vaporized lubricant can also flow back into the system being evacuated to contaminate the system with molecules of the lubricant.

Further, in vacuum pumping it is desirable to have a high volumetric displacement rate of gas from the vacuum region, e.g., to pump out quickly a mass spectrometer or a compartment of a machine where semiconductor devices are fabricated. In general, scroll designs for vacuum pumping produce little or no compression. But scroll pumps solely optimized for high displacement rates are often not well suited for operating across a large pressure differential, e.g., between a few milliTorr at the inlet and atmosphere, 760 Torr, at the outlet, and vice versa. To support a large pressure differential, it is known to use a blade pair with multiple revolutions which produce multiple blade surface-to-blade surface clearance seals that block a back flow of the fluid from the high pressure at the outlet. However, the through put, or displacement capacity, of such a pump is limited.

A seemingly straightforward solution to increasing displacement is to increase the maximum inter-blade spacing so each pocket has a larger volume. For a constant scroll wall thickness this spacing is set by the crank radius. Therefore displacement can, in theory, be increased merely by increasing the crank radius. However, a larger radius has various disadvantages such as an increase in seal velocity and attendant wear, an increase in the radial forces acting on the crank, and an increase in steady state power consumption which relates to seal velocity and friction. A larger crank radius also increases the diameter of the plate and therefore the overall dimensions of the pump. Also, for a given plate diameter, a large crank radius results in fewer revolutions, fewer clearance seals in series and, therefore, more back leakage. The seemingly simple solution of increasing the crank radius is therefore contraindicated by size, wear, and frictional heating considerations.

To increase pump capacity, it is also known to operate multiple scrolls in parallel as done by Iwata Air Compressor Corporation in its model ISP-600 dry scroll vacuum pump. This is a single stage roughing pump using two parallel, back-to-back scroll sets that each have blades with an angular extent of more than four revolutions. While this pump has a nominal capacity of 20 cubic feet per minute (CFM), its pumping speed drops off markedly below 100 milliTorr, presumably due to back leakage through the pump from its outlet to its inlet. This is a quite significant problem in some applications, e.g., in helium leak detection, where a test piece must be evacuated to 20 milliTorr before the leak test can begin. Another problem is that this pump can achieve a base pressure of only 5 milliTorr, whereas, by way of comparison, a commercial two stage rotary, oil-lubricated roughing pump can produce base pressures of 0.5 milliTorr. Yet another problem is that this model Iwata pump uses about 20 feet of tip seal material. Wear of this amount of tip seal produces significant debris which can contaminate the system being evacuated. This amount of sealing material also adversely affects power requirements.

U.S. Pat. No. 3,802,809 to Vulliez discloses a two stage, scroll-type vacuum pump. The device is cooled, but not lubricated, by recirculating, pumped oil. This vacuum pump has an internal bellows and internal oil-carrying passages to isolate the scroll surfaces open to the working fluid from the oil cooling circuit. A drive at one off-center eccentric bearing propels a movable plate or plates. A two stage embodiment is shown, but it uses two movable plates. While Vulliez uses two stages with a nested first stage, the volumetric displacement rates of the stages are required to be equal (column 9, line 54). This arrangement limits the effective volumetric displacement rate attainable by the pump as a combined two stage unit. An in-built electric fan is disclosed as a possible cooling device, but it is auxiliary to the oil cooling circuit.

One recent scroll pump design combines scroll pumps in series to achieve improved operating results. For example, U.S. Pat. No. 5,304,047 to Shibamoto discloses a two stage, scroll-type, oil-lubricated refrigerant compressor. Shibamoto radially separates the inlet of the second stage from the outlet of the first stage. While Shibamoto discloses a two-stage pump, it is not suited for operation as a vacuum pump because it requires a dynamic, oil-lubricated seal at the outer edge of the orbiting second stage scroll to control back leakage of the gas. Also, oil coolant and lubricant is injected onto the moving parts in low and intermediate pressure zones, collected, and recirculated.

It is therefore a principal object of this invention to provide a positive displacement, scroll-type, fluid handling device that has a high volumetric displacement rate at the inlet and which, when used as a vacuum pump, operates steady state between a milliTorr vacuum and atmosphere with a good control over fluid back leakage.

Another object is to provide a fluid handling device with the foregoing advantages that also is characterized by comparatively low steady state power requirements.

A further object is to provide a fluid handling device with the foregoing advantages which can readily produce base pressures of less than 5 milliTorr without oil or other liquid lubricants or coolants being exposed to the working fluid.

Another object is to provide a fluid handling device with the foregoing advantages that has a comparatively low cost of manufacture and good durability.

SUMMARY OF THE INVENTION

A dry, scroll-type, fluid handling apparatus such as a gas vacuum pump has a first stage scroll pump formed by at least two nested pairs of interacting fixed and movable scroll blades mounted in a housing between a fluid inlet and a fluid outlet. An eccentric drive propels the movable blades in an orbital motion, preferably via a generally circular plate with an eccentric drive at its center and with a comparatively small crank radius. Ball bearing pockets located between the plate and the housing synchronize the orbital motion and resist axial thrust loads. In each cycle of operation each co-acting blade pair is open to the vacuum inlet during a portion of the cycle, and closed to the inlet during a subsequent portion of the cycle, at which time this pair is open to the outlet. The blades each extend angularly for a sufficient angular distance, preferably about 360°, to close a pocket in each cycle of operation. This closing and opening in each cycle produces substantially no internal compression of the gas being transported. In a preferred form for vacuum pumping, the outlet from the first stage high-displacement rate scroll pump communicates directly and immediately with the inlet of a second stage scroll pump discharging to atmospheric pressure at the housing outlet. The first stage outlet and second stage inlet are preferably adjacent one another at their outer peripheries.

In the preferred form, the first stage scroll set uses four nested blade pairs with an inlet at the center of the scroll. The second scroll set uses a single pair of blades, but with multiple spiral turns to convey multiple volumes or pockets of gas along the flow path defined by the blades, each separated from adjacent pockets by a moving clearance seal. The second stage outlet is near the center of the spiral blades. The volumetric displacement rate of the first scroll set exceeds that of the second scroll set. To better control back leakage of gas from the high pressure discharge part, the axial height of the blades is kept short, typically about half the axial height of the first stage scroll blades. This provides back leakage control sufficient to allow the first scroll set to operate with only clearance seals. The crank radius is preferably less than twice the thickness of one of the second stage blades.

An air fan, preferably one secured on a central drive shaft for the eccentric gear, cools the device. Fins, preferably a radial array of fins facing the fan, enhance heat conduction to a cooling air stream and stiffen the plate against deformation due to the pressure differential across the pump. Thrust bearings mounted between the plate and the housing (directly or indirectly) resist axial forces and moments acting on the plate. The bearings are sealed, as are bearings of the eccentric drive, to avoid bearing lubricant, e.g., a low vapor pressure grease, from being exposed to the working fluid.

These and other features and objects of the invention will be better understood from the following detailed description which should be read in light of the accompanying drawings.

DETAILED DESCRIPTION OF THE PREFERRED EMBODIMENTS

Figure 1:
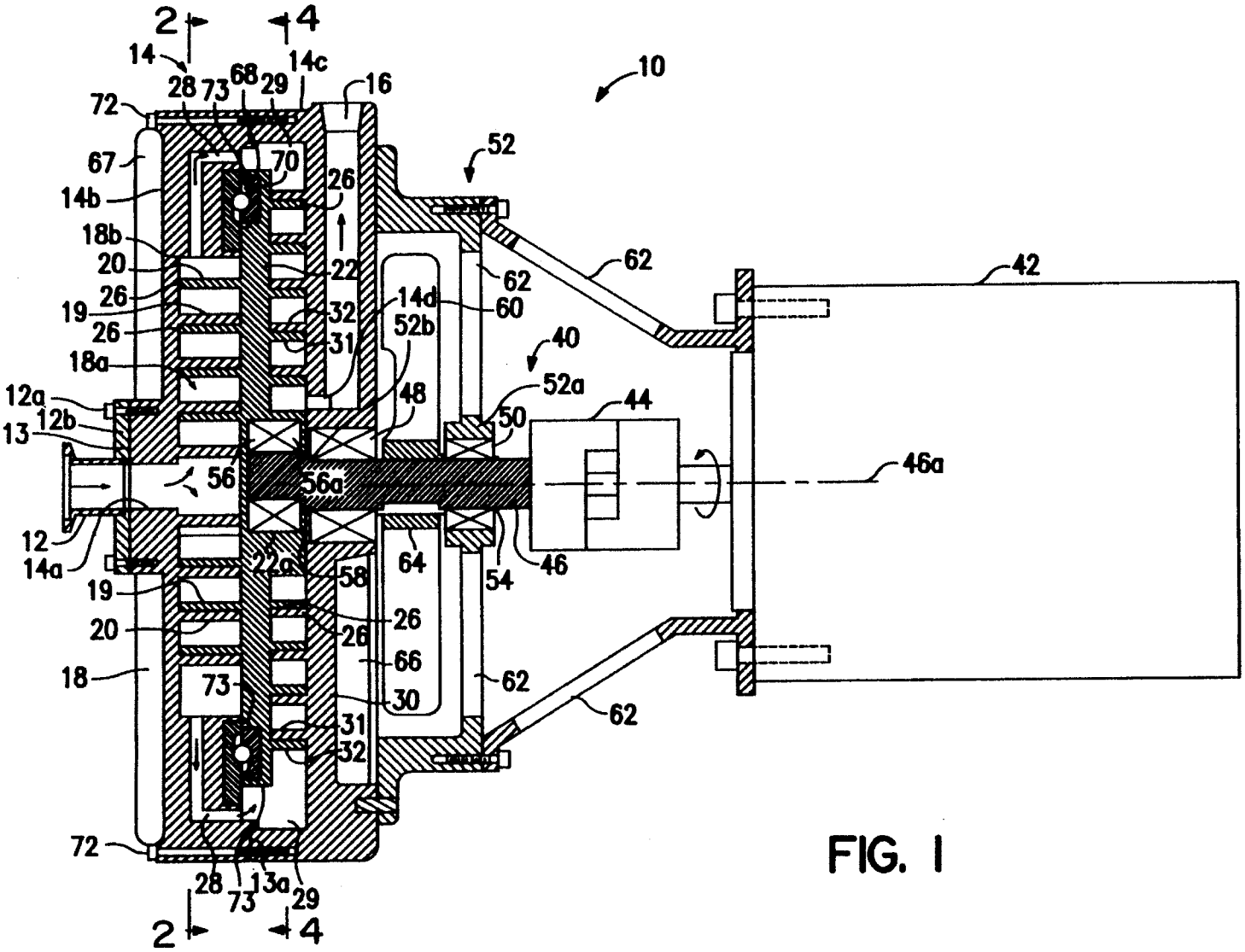
FIG. 1 is a view in vertical section of a two stage vacuum pump constructed according to the present invention.

FIGS. 1–5 show a positive displacement fluid handling device 10 according to the present invention. More particularly, the invention will be described with respect to a preferred embodiment, namely, a dry, two stage vacuum pump. The fluid is a gas, typically air, evacuated from a system, e.g. a container or equipment (not shown), that is connected to a vacuum inlet 12 of the pump. Screws **12*a* and a mounting flange 12*b* secure the inlet 12 over a centrally located inlet port 14*a* in a housing 14. O-ring seals 13 and 13*a* seal the mounting flange 12*b* to the housing 14 and the housing portions 14*b* and 14*c* to one another, respectively. The housing 14 is formed by two hollow halves. Housing portion 14*b* encloses and in part defines a stage I, high displacement pump; housing portion 14*c* encloses and in part defines a stage II low back leakage pump. A central (or radially inward) outlet port 14*d* is formed in the stage II housing near its center. It communicates directly with a radially directed high pressure discharge passage 16 drilled in the housing portion 14*c*** and venting to atmosphere at the outer periphery of the housing.

Figure 2:
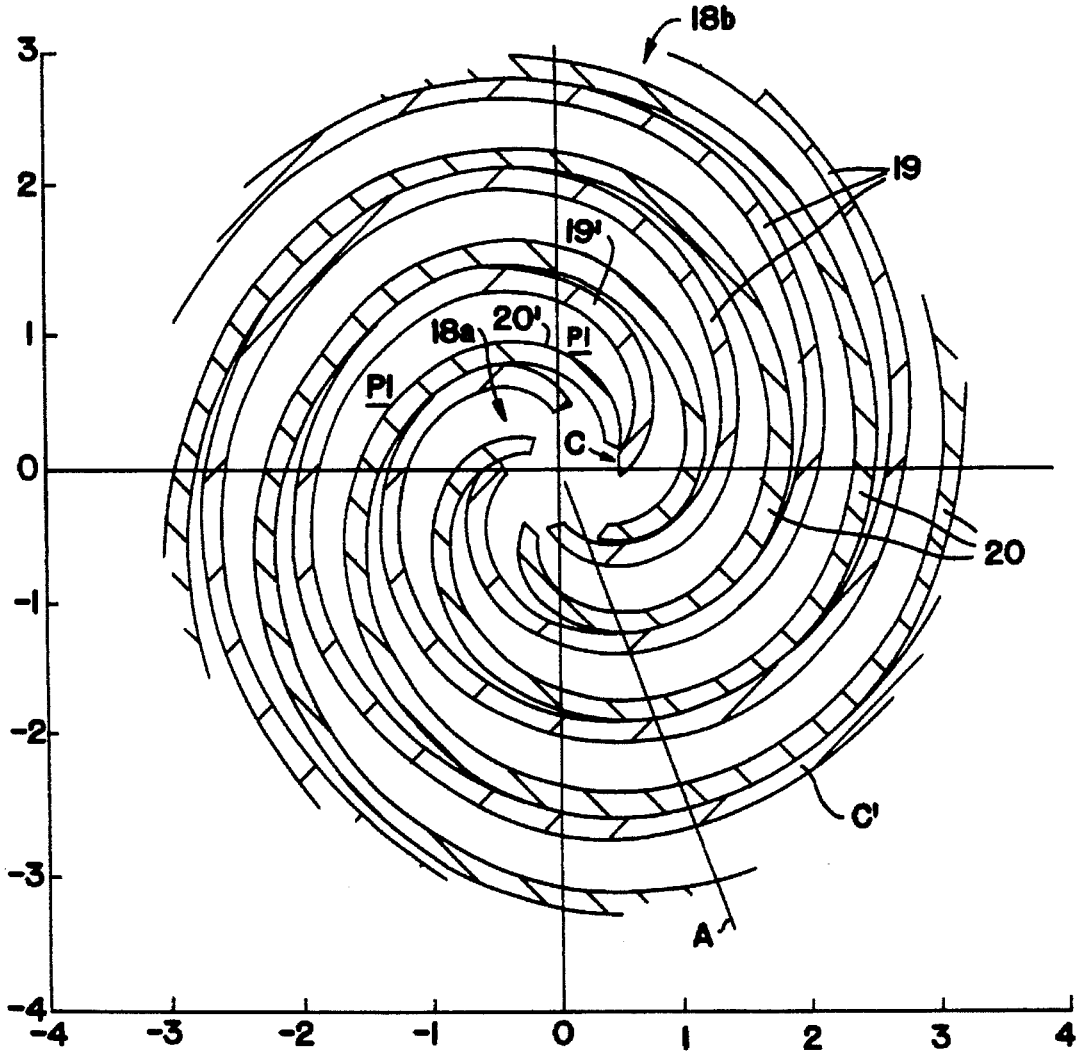
FIG. 2 is a view in side elevation of the first stage scroll set shown in FIG. 1 and taken along line 2—2.
Figure 3:
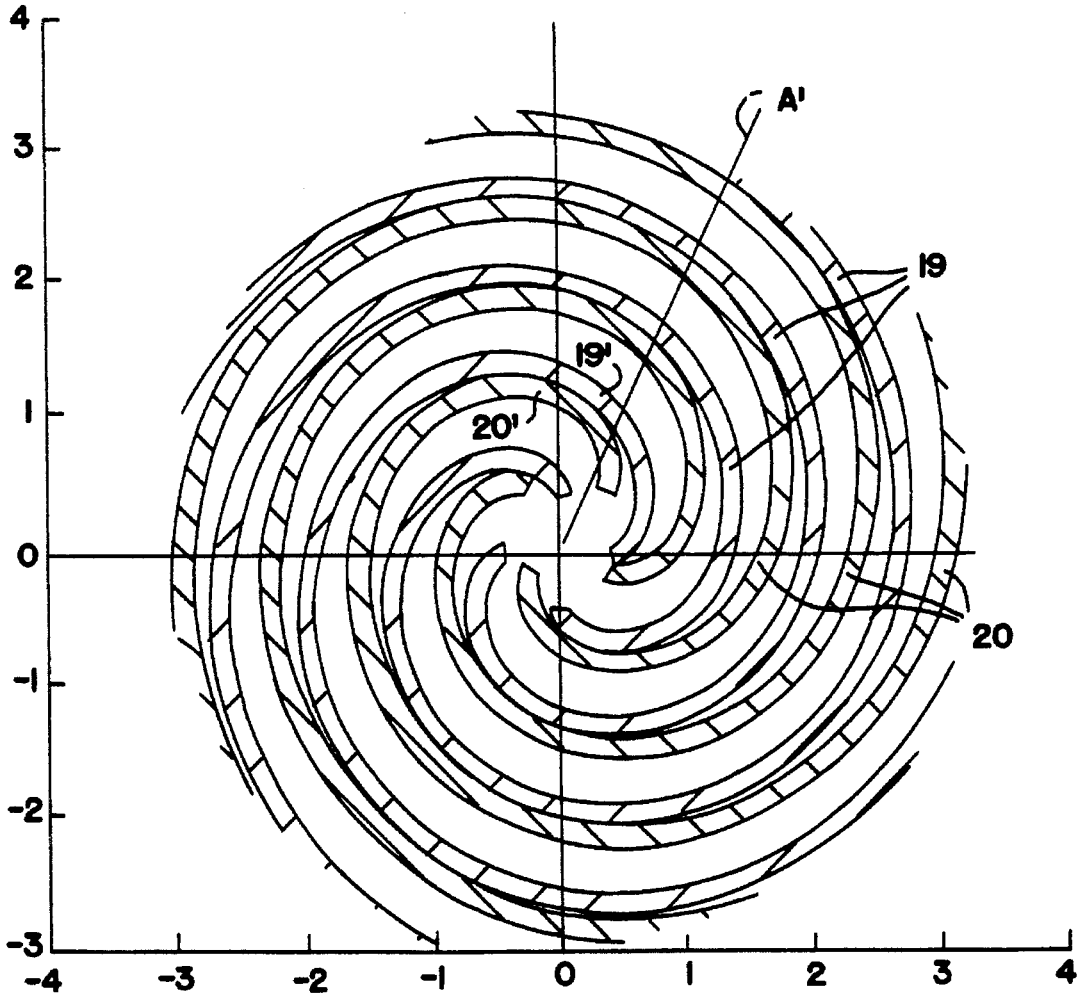
FIG. 3 is a view corresponding to FIG. 2 but with the movable scroll blade orbited to a different position.

A first stage scroll pump 18 is mounted within the housing with its inlet region **18*a* immediately adjacent the inlet port 14*a* and vacuum inlet 12. It is a high volumetric displacement rate pump. As is best seen in FIG. 2 and 3, the scroll pump 18 is formed by four pairs of nested, spiral-shaped blades (or wraps). Each blade pair includes a stationary blade 19, and an orbiting blade 20. The blades 19 are preferably formed integrally with the housing portion 14*b* to facilitate heat transfer and to increase the mechanical rigidity and durability of the pump. The blades 20 in turn are preferably formed integrally with a movable plate 22 for the same reasons. The blades 19 and 20 extend axially toward one another and "interleaf" as shown in FIGS. 1–3. An orbital motion of the plate 22 and the blades 20 produces a characteristic scroll-type pumping action of the gas entering the scroll set at the inlet region 18*a*. It is described in more detail hereinbelow in connection with FIGS. 2 and 3. The free edge of each blade 19 and 20 carries a continuous tip seal 26 of a low-friction, wear resistant, elastomerically energized material such as the seal described with respect to FIG. 7 of U.S. Pat. No. 3,994,636 to McCullough et al. This seal 26 preferably has an outer layer of a Teflon®-based compound with an underlying resilient material that urges the outer layer into a sealing relationship. Each blade 19 and 20 extends axially toward the plate 22 and housing portion 14*b*, respectively, so that there is a light sliding seal at the edge of each blade. In an alternate form of this invention the tip seals 26** may be omitted. There is then a slight clearance between the free edges of the blades and the facing surfaces.

Gas exits the scroll pump 18 at its outer periphery 18*b* where it flows through a set of channels 28 formed in the housing portion 14*b* to an annular inlet region 30*a* of a second stage scroll pump 30 surrounded by an annular plenum chamber 29.

The second stage pump 30 transports the gas input from the first stage pump 18 via the channels 28 and chamber 29. At steady state operation the pump 30 receives gas at some intermediate pressure, e.g., about 50 milliTorr, and discharges it to atmosphere at 760 Torr. It is therefore essential that the pump 30 control backward leakage of gas from an outlet region 30*b* near its center towards the inlet region 30*a* at its outer periphery. (As described in more detail below, in each cycle of operation, gas at atmospheric pressure back fills an innermost pocket, and is then squeezed out as the pocket closes.)

In its presently preferred form the pump 30 has a single pair of stationary and moving blades 31 and 32, respectively, that spiral in multiple revolutions, more than four as shown, for a total angular distance of more than 1440°. Volumes or pockets P9–P16 of working gas entrained in this scroll set are transported in successive cycles of operation as they travel through the pump, here, radially inward along an involute path. The gas pockets are also compressed to some extent since the volume of the pockets decreases as they proceed from the inlet to the outlet. The resulting internal pressure increase within the second stage pump is, however, negligible when compared to the pressure differential between the inlet and the outlet. The pump 30 acts principally through mass transport, not compression. Note that as the radially innermost pocket opens to the outlet it will fill with atmospheric (outlet) pressure gas. Continued orbiting propels this volume of high pressure gas to the outlet and then closes at the outlet in each cycle of operation.

To control back leakage it is a significant aspect of the present invention that the axial height of the blades, 31, 32 be comparatively low. As shown, and presently preferred, the axial height is about half that of the first stage blades 19, 20. The blades 31, 32 each carry a continuous low friction, wear-resistant tip seal 26 on their free edge. As in the pump 18, the tip seal establishes a sliding seal between the blades and the plate and the opposite housing portion, here 14*c*. As is well known, the blades 31 and 32 operate with a slight clearance between their opposing surfaces at the point of their closest approach. There should be no actual contact. This clearance is sufficient to substantially contain the gas in the pockets, but avoids blade-to-blade friction, wear and heating. A low axial height reduces the cross-sectional area available as a leak path in the clearance seal.

The precise value for the height cannot be calculated directly with accuracy; it is determined empirically knowing that the displacement rate is linearly proportional to the axial height of the scroll blades and that leakage is a complex function of clearances and angular alignment between the scroll blades, blade height, leakage across the tip seals, and instantaneous pressures and flow regimes within individual scroll pockets. For a given scroll pump, the desired value for the axial height will also depend, of course, on the overall size of the pump, its desired operating characteristics, and the blade clearance, both new and after use-induced wear. The ultimate controlling design factor for the axial height is whether back leakage is controlled adequately to maintain the desired base pressure in the evacuated system.

It is also a significant aspect of this invention that the volumetric displacement rate of the first stage pump 18 exceeds that of the second stage pump 30. Stated in other words, one aspect of the present invention is that the functions of the stages are separated, optimized, and nevertheless combined in series. The first stage I is optimized for volumetric displacement, which is higher than that of any known two-stage, scroll-type vacuum pump; the second stage is optimized to control back leakage, albeit with a smaller volumetric displacement than the first stage.

FIGS. 2 and 3 show the blades 19, 20 at two positions during a cycle of operation with the blades superimposed on an x-y grid for ease of reference. FIGS. 2 and 3 show a nest of four pairs of movable and stationary blades. In FIG. 2, the inlet is at least partially open to all of the blade pairs except the pair 19', 20' that have closed at C to block any further inflow of gas from the inlet 18*a* to the pocket P1. The outer outlet end of the Pocket P1 is also closed at C'. Continued counter clockwise orbital, not rotational, motion of the movable blade 20' causes the blade 20' to move inwardly away from the immediately adjacent outer stationary blade 19', thus opening the pocket P1 at C'. Gas from the annular region 29 and at some intermediate pressure backfills pocket P1. However, mass flow back to the inlet 18*a* is substantially prevented by continual near contact of blades 19' and 20'. Continued orbiting of blade 20' forces substantially all the gas in P1 out into the annular region 29 via ports 28 as the volume of pocket P1 is reduced to near zero. Because this is a four-nested array, corresponding pocket openings and closings will occur inside and outside each stationary blade 19, albeit at different times in each cycle of operation.

FIG. 3 shows the scroll set of FIG. 2 after the movable blades 20 have orbited at a radius r through 136°, from angular position A to angular position A' about a center of motion at the illustrated x-y coordinates 0,0. The direction of orbiting is counter-clockwise at a speed ω. For each complete orbit of the movable blades 20, a total of eight pockets (two for each blade pair) of somewhat less than 360°angular extent are sequentially closed at the scroll inner ends. As the movable blade set continues to orbit counter clockwise, each trapped pocket is sequentially opened to the outlet 18*b*. Further orbiting movement results in the reduction of the volume of each pocket to near zero, thereby completing one orbit of the movable plate. As in all scroll pumps, this orbital interaction of the blades also propels the working fluid through the scroll set. But with the scroll configuration of FIGS. 2 and 3, there is substantially no compression of the fluid internal to the scroll set. As the inlet to an inter-blade space closes, an outlet located approximately 360°ahead of the inlet opens. Further blade actions moves the fluid in the space to the outlet, but because the fluid is almost immediately in direct fluid communication with the outlet, there is a negligible increase in fluid pressure due to compression. This type of device is commonly referred to as a positive displacement pump. Fluid at the exhaust pressure rushes in, pressurizing the pocket to that pressure.

Because of the design and nesting of blades, and the resulting comparatively large percentage of the interior volume of the pump 18 that is filled at any moment in the cycle of operation by the fluid, the volumetric displacement rate of the pump 18 is high, particularly for a dry scroll pump. For a given pump size, operated under the same conditions, the volumetric displacement rate is calculated to be about two times the best rate heretofore achievable with dry scroll pumps.

Figure 4:
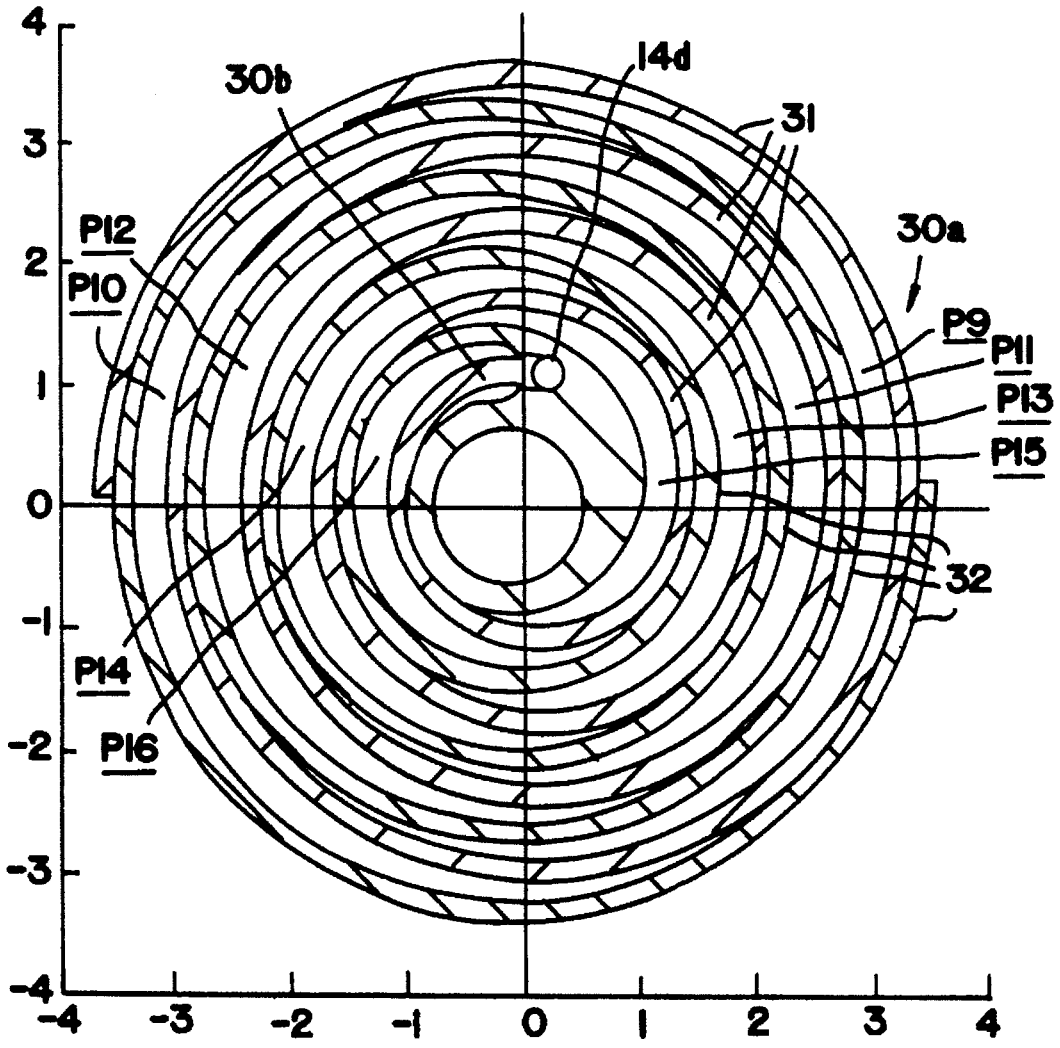
FIG. 4 is a view in side elevation of the second stage scroll set shown in FIG. 1 and taken along line 4—4.

FIG. 4 shows the single pair, multiple revolution scroll set of the second stage pump 30 superimposed on a grid of the same dimension as the grid of FIGS. 2 and 3. The fluid inlet region 30*a* extends in an annular band around the outer periphery of the pump 30. The fluid enters and is enclosed in two pockets P9 and P10. Because the pump 30 has its movable blade 32 mounted on the opposite side of the plate 22 from the movable blade 20, the direction of orbiting is clockwise as shown, again about a center at the x, y coordinate 0,0 in FIG. 4. The orbit radius is, of course, again r. Successive orbits of the blade 32 in successive cycles of operation causes the enclosed masses of gas to travel radially inwardly through the scroll. As noted above, there is some compression since the volume in the pockets decreases, but the degree of this compression is negligible when compared to the pressure differential supported across the pump 30. The radially innermost pocket P16 backfills with exhaust pressure gas which is squeezed out again as continued orbiting of the scroll set reduces the volume of this pocket and then closes it. The many turns of the scroll blades of this pump creates a long leak path with multiple clearance seals spaced serially along the involute path. As shown, the pump 30 uses a single fixed blade and a single orbiting blade, each with an angular extent of more than four 360°spiral turns.

Referring again to FIG. 1, a drive 40 for the pumps 18 and 30 is powered by an electric motor 42 connected by a rubber spider coupling 44 to a drive shaft 46 mounted in axially spaced bearings 48, 50. Bearing 50 is supported in a collar 52*a* of a housing 52. A snap ring 54 secures the bearing 50 in the collar 52*a* in cooperation with a seating recess 52*b*. An eccentric, grease-loaded, sealed, ball bearing 56 secured on the end of the drive shift 46 connects to the plate 22 in a central collar 22*a* of the plate. There is a clearance between the drive shaft and the housing portion 14*c* so the only friction occurs in the bearings and at a dry seal 58 at the interface between the end of the orbiting collar 22*a* and the facing surface of the housing portion 14*c*. The seal 58 can be of the same material as used for the tip seals 26.

A fan 60 secured on the drive shaft in the housing 52 produces a flow of cooling air through ports 62 in the housing 52 onto the outer surface of the housing portion 14*c*. A counterweight 64 is formed integral with the fan 60 in order to balance the mass of the plate 22 which is orbiting eccentric with respect to the axis of rotation 46*a* of the drive shaft. A set of metallic fins 66 are mounted in a radial orientation in a recess in the outer face of the housing portion 14*c*. The fins enhance heat transfer from the pumps 18 and 30 to an air flow produced by the fan. The fins 66 also stiffen the housing 14*c* to resist deformation due to the pressure differential across the housing (at steady state operation, a differential of a few milliTorr to one atmosphere). Deformation is highly undesirable since it varies the scroll wall clearance spacings within the scroll pump 30 which can increase both gas leakage and blade wear. Fins 67 on the housing portion 14*b* serve the same function as fins 66.

A set of thrust bearings 68 are dispersed in a circular array between the outer periphery of the plate 22 and the outer, inwardly facing surface of the housing part 14*b*. The thrust bearings are of the type described in U.S. Pat. No. 4,259,043. Each bearing 68 includes a spherical ball bearing 70 held in two mirror image, circular recesses in the plate and in the housing. Preferably, these recesses are ground to close tolerances in inserts of a wear resistant, hardened material, typically a tool steel. For the present preferred applications as a dry vacuum pump, the bearings are grease-loaded with a low vapor pressure fluorinated grease such as the product sold by I.E. duPont de Nemours and Co. under the trade designation "Krytox 240AC". Seals 73 prevent grease from exiting the bearings 68.

The bearings serve two functions. They resist compressive loads produced principally by the differential fluid pressures acting on the plate 22 and they synchronize the relative motion of the scroll blades, that is, they hold the plate 22 in a fixed angular orientation as the eccentric 46 rotates. The rotary motion of the drive shaft is thereby faithfully translated into the desired orbital motion.

The pump 10 is readily assembled and disassembled for replacement of defective or worn parts. Removal of screws 72 allows the housing portions 14*b* and 14*c* to be separated axially by pulling the portion 14*b* away from the portion 14*c*. The plate 22 is then accessible and can be pulled off the eccentric bearing 56.

By way of illustration, but not of limitation, for a dry vacuum pump with a displacement capacity of 10 $ft^3$/min (CFM) producing a steady state vacuum of 3 milliTorr the scroll plate 22 has a diameter of 9.0 inches, a thickness, exclusive of the blades, of ⅜ inch, and is formed of any suitable structure material such as cast aluminum. After the scrolls are milled to close tolerances they are hardcoated to improve the surface properties of the aluminum. The first stage scroll blades have a height of about 1 inch and a thickness of 0.157 inch. The second stage blades have a height of about 0.5 inch and a thickness of 0.157 inch. The minimum blade-to-blade clearance in the first and second stages is 0.003 inch. The first stage has roughly three times the volumetric displacement rate of the second stage. The blades have the number and configuration shown in FIGS. 2–4. The motor 40 rotates at 1740 rpm and consumes about 450 watts steady state.

A significant aspect of this invention is that a high displacement rate and low back leakage can be attained with a comparatively small crank radius, e.g., 0.157 inch in the illustration given above. The crank radius is preferably less than twice the thickness of blade 31 or 32. As noted above, heretofore such a small crank radius was considered incompatible with a high displacement rate since it translated into a correspondingly small volume in the scroll pump pockets. The nested, two or more blade pairs of the first stage pump 18 with the radial and angular configuration and dimensions described above, produces a high displacement rate with only this small crank radius—preferably on the order of magnitude of the blade thickness.

The small crank radius of this invention has a major advantage in that it reduces the velocity of the tip and other seals (since velocity is proportional to the crank radius). This in turn reduces seal wear which results in a longer maintenance interval and less seal wear contamination. A regular maintenance interval of 9,000 hours is anticipated. The small crank radius also reduces the radial crank force, which it is also proportional to the radius, as well as reducing frictional heating and steady state power consumption. Further, because the first and second stage pumps orbit on the same radius, a small crank radius allows more revolutions of the second stage blade pair which produces more serially spaced clearance seals and radially spaced tip seals reducing back leakage, whether past the clearance seals or the tip seals. In fact, the back leakage control provided by this invention allows the complete omission of tip seals in the first stage pump 18. This has clear cost, wear and maintenance advantages.

As with the axial height calculation, there is no one correct value for the crank radius. The value can be determined empirically from the end performance objectives and the optimization of one or more of the parameters noted above, e.g., wear reduction, power consumption, back leakage control, initial cost reduction, etc.

Figure 5:
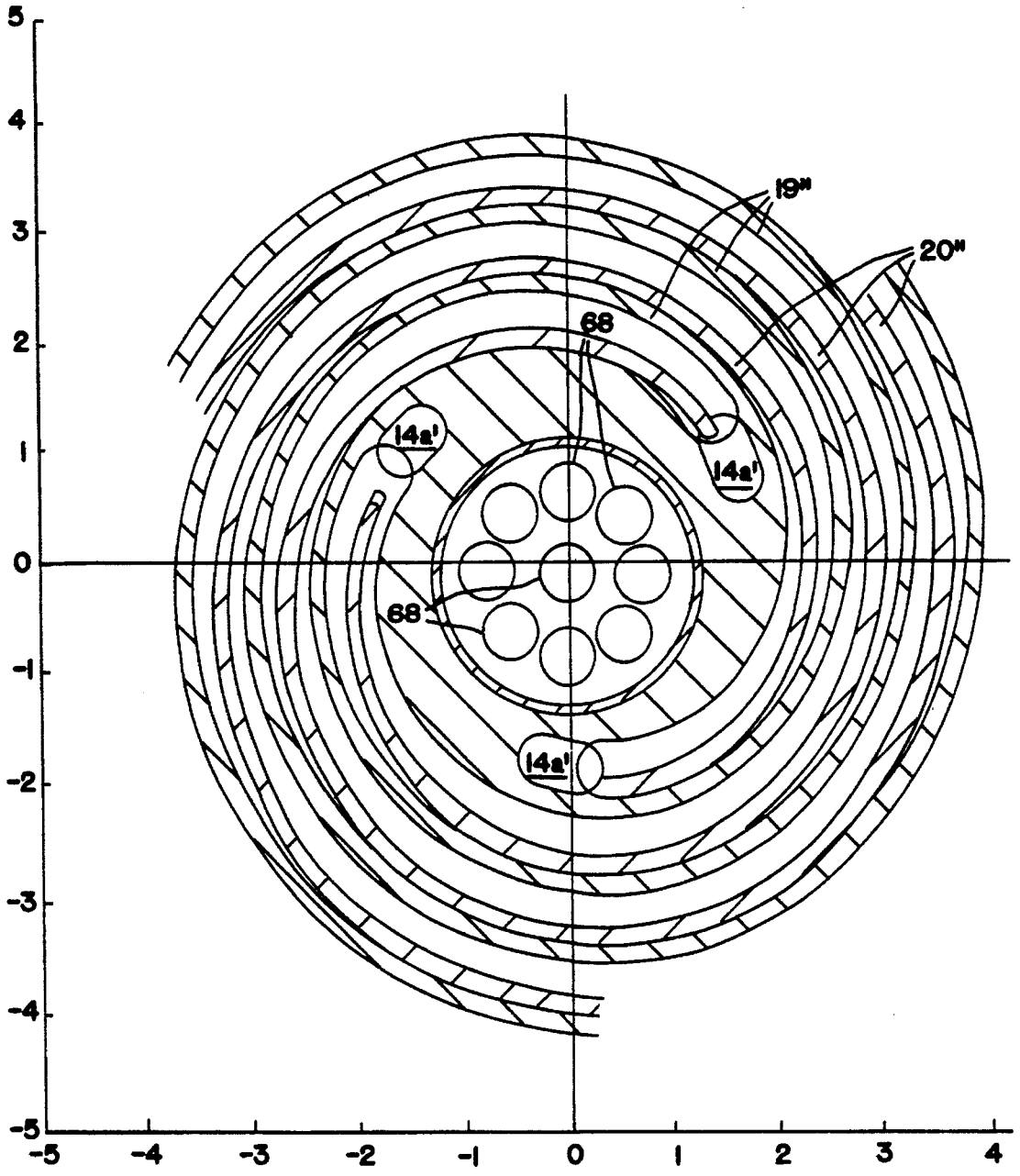
FIG. 5 is a view in side elevation corresponding to FIGS. 2 and 3 of an alternative first stage scroll set configuration and synchronization bearing array.

FIG. 5 shows an alternative construction for the first stage scroll set where the thrust bearings 68 are arrayed in a circle located inside three nested pairs of spiral blades 19", 20", which as shown here, extend angularly over one revolution. This arrangement uses fewer bearing seals and allows the bearings to oppose axial forces more directly. This arrangement provides less resistance to moments tending to produce wobbling of the plate. Three inlet ports 14*a'*are shown at the termination of the three innermost pockets. A circular seal 90 of the same material as the seals 26 and 58 surrounds the bearings 68.

There has been described a high displacement rate, scroll-type, fluid handling apparatus which operates with a high displacement rate, yet which when operated as a vacuum pump can support a base pressure of less than 5 milliTorr. The pump can operate dry, with no liquid lubricant or coolant interacting with the fluid. It can produce these results with a comparatively low power consumption and with a design that operates with long intervals between routine maintenance, particularly tip seal replacement. The pump may even operate without first stage tip seals.

While the invention has been described with reference to its preferred embodiments, it will be understood that various modifications and alterations will occur to those skilled in the art from the foregoing detailed description and the accompanying drawings. For example, the invention can operate with plural orbiting plates, one for each stage, and with a different number of nested scrolls, e.g., five, and angular extent of blades (e.g., 340°–380°) in the first stage, but with certain trade-offs. Similarly, while the preferred embodiment uses air cooling exclusively, this invention can be used with liquid lubricants and coolants, although with the attendant contamination problems noted above, as well as the cost of providing systems, seals, and the like to support liquid cooling and/or lubricants. Further, while the invention has been described with a common central eccentric drive, it is possible to utilize the features and advantages of this invention with other known eccentric drives such as multiple peripheral cranks. These and other modifications are intended to fall within the scope of the appended claims.

What is claimed is:

1. A high volumetric displacement rate fluid handling apparatus comprising a housing with an inlet and an outlet for the fluid, a first scroll set of at least two nested pairs of fixed and movable spiral blades mounted in said housing, said first scroll set having an inlet and an outlet, with said inlet in fluid communication with said housing inlet, a plate mounted within said housing that carries said movable blades, an eccentric drive operatively connected to said plate and said movable blades that causes said movable blades to orbit said fixed blades and thereby interact with the fluid in inter-blade pockets, said at least two pairs of fixed and movable blades being in a nested array and each extending from a point adjacent the center of said first scroll set to a point adjacent its periphery over an angular distance sufficient to close said pockets in each cycle of operation, a second scroll set mounted in said housing formed of at least one pair of fixed and movable spiral blades that both extend angularly for multiple revolutions, said eccentric drive also propelling said movable spiral blades of said second stage scroll set to move in an orbital motion that creates a series of inter-blade pockets moving toward said housing outlet, said second scroll set having an inlet and an outlet, and a fluid connection between said outlet of said first scroll set to said inlet of said second scroll set, said second scroll set discharging the fluid from said second scroll set outlet to said housing outlet, said first scroll set having a volumetric displacement rate at its inlet that is greater than the volumetric displacement rate of said second scroll set.

2. The high displacement rate fluid handling apparatus of claim 1 wherein second scroll set blades have an axial height less than that of said blades of said first scroll set.

3. The high displacement rate fluid handling apparatus of claim 1 wherein said fluid connection is located at the outer periphery of said first and second scroll sets.

4. The high displacement rate fluid handling apparatus of claim 1 wherein said first scroll blades each extend angularly over about one revolution.

5. The high displacement rate fluid handling apparatus of claim 4 wherein there are four of said nested blade pairs in said first scroll set and the ratio of the pressure of the fluid at said first scroll set inlet to the pressure of the fluid as said first scroll set outlet is about 1:1.

6. The high displacement rate fluid handling apparatus of claim 1 wherein said fixed blades are secured to said housing, said drive includes a drive shaft and an eccentric bearing generally connected between the center of said plate and said drive shaft.

7. The high displacement rate fluid handling apparatus of claim 6 wherein said first scroll set inlet is located adjacent the center of said first scroll set and said second scroll set outlet is located adjacent the center of said second scroll set.

8. The high displacement rate fluid handling apparatus of claim 1 wherein said second scroll set has said fixed blade secured on said housing and said movable blade secured on said plate on the opposite side from said movable blades of said first scroll set.

9. The high displacement rate fluid handling apparatus of claim 1 wherein said first scroll set is about twice as high as said second scroll set.

10. The high displacement rate fluid handling apparatus of claim 1 wherein said eccentric drive includes a plurality of sealed thrust bearings mounted between said plate and said housing disposed to resist axially directed forces and moments parallel to the axis of said drive and to synchronize said orbiting.

11. The high displacement rate fluid handling apparatus of claim 10 wherein said thrust bearing are located around the periphery of said plate and said housing.

12. The high displacement rate fluid handling apparatus of claim 10 wherein said thrust bearings are located radially within said first scroll set blades.

13. The high displacement rate fluid handling apparatus of claim 1 wherein the radius of said orbiting is less than twice the thickness of one of said second scroll blades.

14. The high displacement rate fluid handling apparatus of claim 1 wherein said first scroll set has only blade-to-blade clearance seals.

15. The high displacement rate fluid handling apparatus of claim 1 wherein said first scroll set has at least three of said nested blade pairs.

16. A high volumetric displacement rate fluid handling apparatus comprising a housing with an inlet and an outlet for the fluid, a first scroll set of at least two nested pairs of fixed and movable spiral blades mounted in said housing with a first scroll set inlet and a first scroll set outlet, said first scroll set inlet being in fluid communication with said housing inlet, a plate mounted within said housing that carries said movable blades, an eccentric drive operatively connected to said plate and said movable blades that causes said movable blades to orbit said fixed blades and thereby interact with the fluid in inter-blade pockets, said at least two pairs of fixed and movable blades being in a nested array and each extending from a point adjacent the center of said first scroll set to a point adjacent its periphery over an angular distance sufficient to close said pockets in each cycle of operation, a second scroll set mounted in said housing formed of at lease one pair of fixed and movable spiral blades that both extend angularly for multiple revolutions, said eccentric drive also propelling said movable spiral blades of said second stage scroll set to move in an orbital motion that creates a series of inter-blade pockets moving toward said housing outlet, said second scroll set having an inlet and an outlet, and a fluid connection between said outlet of said first scroll set to said inlet of said second scroll set, said second scroll set discharging the fluid from said second scroll set outlet to said housing outlet, and said second scroll set blades have an axial height less than that of said blades of said first scroll set.

17. The high displacement rate fluid handling apparatus of claim 16 wherein said first scroll set is about twice as high as said second scroll set.

18. The high volumetric rate fluid displacement apparatus of claim 16 wherein said fluid connection is located at the outer periphery of said first and second scroll sets.

19. The high displacement rate fluid handling apparatus of claim 16 wherein said first scroll blades each extend angularly over about one revolution.

20. The high displacement rate fluid handling apparatus of claim 16 wherein said second scroll set has said fixed blade secured on said housing and said movable blade secured on said plate on the opposite side from said movable blades of said first scroll set.

21. The high displacement rate fluid handling apparatus of claim 16 wherein said eccentric drive includes a plurality of sealed thrust bearings mounted between said plate and said housing disposed to resist axially directed forces and moments parallel to the axis of said drive and to synchronize said orbiting.

* * * * *